United States Patent [19]

Gaskin et al.

[11] Patent Number: 4,913,067

[45] Date of Patent: Apr. 3, 1990

[54] STOKER CONSTRUCTION

[75] Inventors: Matthew J. Gaskin, Williston Park; Stanley W. Kroon, Long Island City; Thomas Tsaveras, Elmont, all of N.Y.

[73] Assignee: Morse Boulger, Inc., Long Island, N.Y.

[21] Appl. No.: 394,255

[22] Filed: Aug. 11, 1989

Related U.S. Application Data

[63] Continuation of Ser. No. 134,812, Dec. 18, 1987, abandoned.

[51] Int. Cl.[4] ..... F23H 7/08; F23H 7/14

[52] U.S. Cl. ..... 110/281; 110/165 R; 110/255; 110/257; 110/259; 110/291

[58] Field of Search ..... 110/224, 227, 228, 235, 110/255, 257, 258, 259, 267, 268, 278, 281, 282, 286, 291, 165 R; 414/150

[56] References Cited

U.S. PATENT DOCUMENTS

| | | | |
|---|---|---|---|
| 3,317,202 | 5/1967 | Cates, Jr. et al. | 110/228 X |
| 3,713,403 | 1/1973 | Maille | 110/235 |
| 3,863,578 | 2/1975 | Kato et al. | 110/257 |
| 4,170,183 | 10/1979 | Cross | 110/257 X |
| 4,320,710 | 3/1982 | Steiner et al. | 110/255 X |
| 4,452,152 | 6/1984 | John et al. | 110/171 X |
| 4,495,872 | 1/1985 | Shigeki | 110/257 X |
| 4,563,959 | 1/1986 | Fujiwara | 110/278 X |
| 4,676,176 | 6/1987 | Bonomelli | 110/291 X |

*Primary Examiner*—Edward G. Favors
*Attorney, Agent, or Firm*—Lalos & Keegan

[57] ABSTRACT

A stoker comprising a housing defining first, second and third plenum chambers, a grate unit disposed at an upper end of each plenum chamber, a first residue removal means disposed at a lower end of the first plenum chamber, a second residue removal means disposed at a lower end of the second plenum chamber for receiving residue from the first residue removal means and a third residue removal means disposed at a lower end of the third plenum chamber for receiving residue from the second residue removal means.

10 Claims, 1 Drawing Sheet

STOKER CONSTRUCTION

Figure 1:
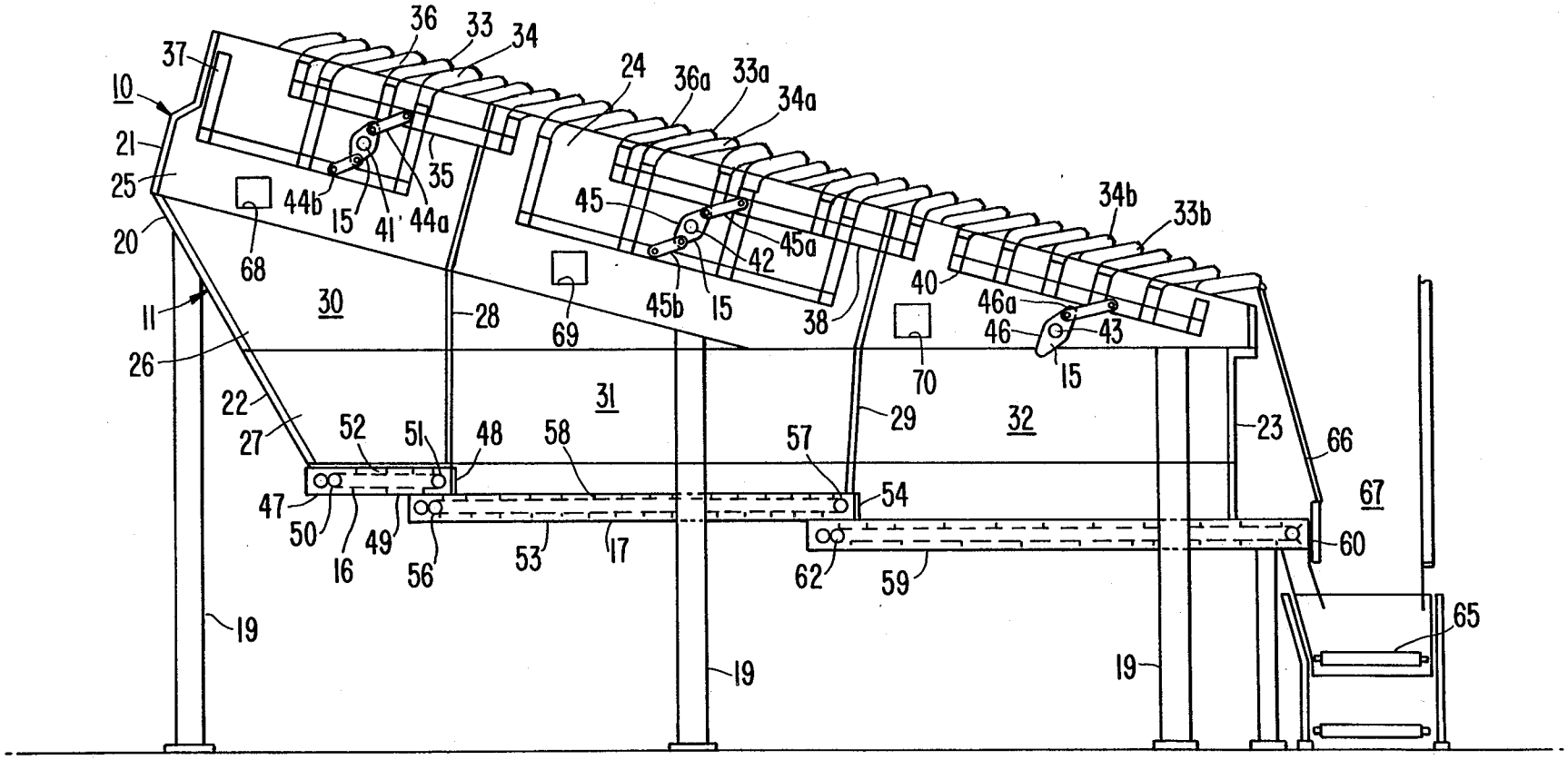

This is a continuation of Ser. No. 134,812, filed Dec. 18,1987, now abandoned.

This invention relates to the incineration of refuse and more particularly to an improved stoker construction suitable for use in municipal, industrial and commercial facilities for the reduction of refuse and the recovery of energy therefrom.

Typically, a municipal, industrial or commercial type of incinerator facility includes a combustion chamber having a feed chute for charging raw refuse into the combustion chamber and a flue for the removal of the products of combustion. Disposed within the combustion chamber, there usually is provided a reciprocating type of stoker which is adapted to receive raw refuse charged into the incinerator chamber through the feed chute and advance the refuse along the length thereof as it is burned. The refuse is ignited by burners provided in the walls of the incinerator and combustion of the refuse is maintained and controlled by injecting combustion air above and below the grates of the stoker. The stoker advances the refuse along the length thereof by reciprocating spaced sets of grates which has the effect of both advancing and upsetting the refuse to enhance the burning process.

Generally, the stoker provides an upper feed and drying section in which newly charged refuse is deposited and begins to dry out, an intermediate combustion section in which the principal combustion of the dried refuse occurs and a lower burnout section in which burnout is completed just prior to discharging the ash residue onto a conveyor for removal from the combustion chamber.

Typical refuse charged into an incinerator has a Btu content in the range of 4,500 to 6,000 Btu per pound. Ideally, to provide optimum reduction of such refuse and extract a maximum of heat energy, optimum combustion of the refuse must occur. To obtain optimum combustion, there must be provided a suitable residence time of the refuse as it advances along the length of the stoker, a proper combustion chamber temperature, usually in the range of 1450° F. to 1650° F., sufficient agitation of the refuse in transit to provide maximum exposure and a controlled supply of combustion air.

While it is desirable to obtain optimum combustion to provide maximum refuse reduction and optimum heat energy release, it further is desirable to provide efficient operating conditions in order to maintain a steady throughput of refuse, conserve on energy input and protect the combustion chamber walls and the stoker components from undue erosion.

Accordingly, it is the principal object of the present invention to provide an improved stoker construction.

Another object of the present invention is to provide an improved stoker construction suitable for use in the reduction of refuse and the recovery of heat energy thereof.

A further object of the present invention is to provide an improved stoker construction suitable for use in municipal, industrial and commercial incineration facilities.

Another object of the present invention is to provide an improved stoker construction which provides an optimum reduction in refuse and a maximum recovery of heat energy.

A further object of the present invention is to provide an improved stoker construction which is efficient in operation in optimizing refuse reduction and recovery of heat energy.

A still further object of the present invention is to provide an improved stoker construction which is operable efficiently to provide optimal refuse reduction and maximum heat energy recovery while providing minimal erosion of combustion chamber walls and stoker components.

Another object of the present invention is to provide an improved stoker construction which is simple in design, comparatively inexpensive to manufacture, effective in performance and capable of a long service life.

Other objects and advantages of the present invention will become more apparent to those persons having ordinary skill in the art to which the present invention pertains from the following description taken in conjunction with the accompanying drawing which illustrates a vertical cross-sectional view of an embodiment of the invention.

The embodiment shown in the drawing consists of a stoker 10 adapted to be installed in a combustion chamber of a municipal, industrial or commercial incineration facility which generally includes a housing 11, upper, intermediate and lower grate units 12, 13 and 14 mounted on the housing, a drive system 15 mounted on the housing and operatively connected to the grate units, and ash removal units 16, 17 and 18.

Housing 11 is supported on a set of structural members 19 and includes a rear wall 20 having an upper section 21 and a lower forwardly inclined section 22, a front wall 23 and a pair of side walls 24, each having a vertically disposed upper section 25, an intermediate inwardly inclined section 26 and a lower inwardly inclined section 27, providing upper and lower open ends. The housing further is provided with transversely disposed partitioned walls 28 and 29 which cooperate with the front, rear and side walls to provide plenum chambers 30, 31 and 32. The upper and lower ends of plenum chamber 30 are closed by grate unit 12 and residue removal unit 16. Similarly, the upper and lower ends of plenum chamber 31 are closed by grate unit 13 and residue removal unit 17, and the upper and lower ends of plenum chamber 32 are closed by grate unit 14 and residue removal unit 18.

Grate unit 12 consists of an assembly of longitudinally spaced sets of grates 33 supported on cross beams mounted on upper side wall sections 25, an assembly of longitudinally spaced sets of grates 34 disposed in a first alternate set of spaces between stationary grates 13, supported on a carriage 35, and an assembly of longitudinally spaced sets of grates 36 disposed in a second alternate set of spaces between stationary grates 33 and supported on a carriage 37. Carriages 35 and 37 are supported on cross beam members rigidly secured to upper wall sections 25, and are adapted to reciprocate relative to each other to correspondingly reciprocate sets of grates 34 and 36 relative to each other and to sets of stationary grate 33.

Grate unit 13 is similar in construction and operation to grate unit 12 and includes an assembly of longitudinally spaced sets of stationary grates **33*a* supported on cross beams rigidly mounted on upper wall sections 25, an assembly of longitudinally spaced sets of grates 34*a* disposed in a first alternate set of spaces between sets of stationary grates 33*a* and supported on a carriage 38, and an assembly of longitudinally spaced sets of grates 36a disposed in a second set of alternate spaces between sets of stationary grates 33a and supported on a carriage 39. Carriages 38 and 39 are supported on cross beams rigidly mounted on upper wall sections 25 of the housing and are adapted to reciprocate relative to each other to correspondingly reciprocate sets of grates 34a and 36a relative to each other and to sets of stationary grates 33a**.

Grate unit 14 includes an assembly of longitudinally spaced sets of grates 33b supported on cross beam members rigidly mounted on upper side wall sections 25 of the housing, and an assembly of longitudinally spaced sets of grates 34b disposed in spaces between sets of stationary grates 33b and supported on a carriage 40. Carriage 40 is supported on cross beam members rigidly mounted on the upper wall sections of the housing and is adapted to reciprocate to correspondingly reciprocate sets of grates 34b relative to sets of stationary grates 33b.

Drive system 15 includes a set of pivot shafts 41, 42 and 43 each journaled in the upper wall section of the housing and a set of crank arms 44, 45 and 46 mounted thereon, respectively, which are connected by links 44a and 44b with carriages 35 and 37, links 45a and 45b with carriages 38 and 39, and link 46a with carriage 40, respectively. Pivot shafts 41, 42 and 43 are operatively connected through crank arm mechanisms with one or more hydraulic cylinder assemblies which are operated to extend and retract and correspondingly reciprocate carriages 35 and 37 through 40 and thus provide a stoking action on refuse deposited on the stoker.

Residue removal unit 16 consists of an enclosure 47 having an upper end communicating with plenum chamber 30 and a flap gate 48 hingedly connected to the lower end of partition wall 28. The enclosure houses a continuous drag chain 49 trained about a drive sprocket 50 and an idler sprocket 51, and provided with a plurality of paddles which engage siftings deposited on the bottom wall of the enclosure and sweep them forwardly through flap gate 48 and discharge them into residue removal unit 17.

Residue removal unit 17 is similar in construction and operation to unit 16. It includes an enclosure 53 disposed partially under and below the level of removal unit 16, having an open upper end communicating with plenum chamber 31 and a flap gate 54 disposed at the leading end thereof and hinged to the lower end of partition wall 29. Disposed within enclosure 53 is a continuous drag chain 55 trained about a drive sprocket 56 and an idler sprocket 57, and provided with a plurality of paddles 58 which function to engage siftings deposited on the bottom wall of enclosure 53, sweep them toward and through flap gate 54 and discharge them into residue removal unit 18.

Residue removal unit 18 is similar in construction and operation to residue removal unit 17 and includes an enclosure 59 at a level below and partially under residue removal unit 17. It is provided with an upper open end communicating with plenum chamber 32 and a hinged flapper valve 60 at its leading end. Disposed within enclosure 59 is a continuous drag chain 61 trained about a drive sprocket 62 and an idler sprocket 63 and provided with a plurality of paddles 64 which are adapted to engage residue deposited on the bottom wall of enclosure 59, sweep such residue through flap gate 60 onto a transversely disposed conveyor 65 which removes both siftings and ash residue from the combustion chamber.

In the operation of the stoker as described, refuse initially is deposited on the upper end of the stoker and drive system 15 is operated to reciprocate sets of grates 36 through 36b and 34 to advance the refuse along the length of the stoker and to upset it as it advances. The refuse is ignited as it advances along the length of the stoker and combustion is maintained by the burning refuse after initial ignition. As refuse continues to be fed through a feed chute onto the upper end of the stoker the heat generated by the burning refuse will function to dry the refuse as it passes through the feed and drying section of the stoker. As the refuse advances through the intermediate or combustion section of the stoker, it will be upset by the reciprocating action of the stoker to expose the refuse to the combustion flames. The principal burning of the refuse occurs in this intermediate or combustion section of the stoker. As the burned refuse continues to be advanced to the lower end of the stoker, it is agitated or upset to a lesser extent allowing it to burn out yet preventing it from exposing the grates which otherwise would be exposed to the harmful effects of the elevated combustion temperatures. Finally, the ash residue at the lower end of the stoker is guided by a sloped panel 66 through a vertical passageway 67 onto conveyor 65.

As sets of grates 34 and 36 reciprocate to stoke partially burning refuse in the feed and drying section of the stoker, siftings therefrom will be caused to fall through plenum chamber 30 and be deposited on the bottom wall of enclosure 47 of residue removal unit 16. Similarly, siftings from sets of grates 34a and 36a of the combustion section of the stoker will fall through plenum chamber 31 and be deposited on the bottom wall of enclosure 53 of residue removal unit 17, and siftings from reciprocating sets of grates 34b will fall through plenum chamber 32 and be deposited on the bottom wall of enclosure 59 of residue removal unit 18. Siftings deposited on the bottom wall of enclosure 47 will be swept by the paddles on conveyor 49 to the leading end thereof where eventually they will accumulate and force open flap gate 48. The siftings will then be discharged onto the bottom wall of enclosure 53. The paddles of chain 55 will then sweep the siftings on bottom wall 53 to the leading end thereof where they will accumulate until they force open flap gate 58 and be discharged onto the bottom wall of enclosure 59. From there, siftings will be swept toward the leading end of enclosure 59 from where they are discharged through flap gate 60 onto conveyor 65.

Under optimum operating conditions, the reciprocating action of the stoker is adjusted to provide an appropriate residence time of the refuse on the stoker and a sufficient amount of turbulence to agitate and upset the refuse, particularly in the combustion section of the stoker, a sufficient amount of combustion air is supplied through inlets 68, 69 and 70 to maximize burning and maintain the temperature in the range of 1450° F. and 1650° F. The temperature is maintained in the 1450° F. to 1650° F. range by varying the ratio of underfire and overfire air. When it is desired to increase the combustion temperature, the supply of under fire air is increased or the supply of underfire air is increased and the supply of overfire air is decreased. To lower the combustion temperature, the overfire air is increased or the supply of overfire air is increased and the supply of underfire air is decreased.

To further enhance the combustion process and maximize efficiency, a pressure gradient is maintained across the grates and the pressure is varied below the grates along the length of the stoker. Ideally, a positive pressure is maintained in the zones below the grates and a slightly negative pressure is maintained in the zone above the grates, and the positive pressure in plenum chamber 31 is maintained at a pressure above the pressure in plenum chamber 30 and the positive pressure in plenum chamber 32 is maintained below the pressure in plenum chamber 30. Preferably, the positive pressures below the grates will be two inches of water in plenum chamber 30, four inches in water in plenum chamber 31 and one inch of water in plenum chamber 32, and the negative pressure in the combustion chamber above the grates will be in the order of −0.1 inches to −0.5 inches of water.

Although none of plenum chambers 30, 31 and 32 are entirely sealproof, the desired positive pressures in such chambers are capable of being maintained at their upper ends by the closely fitted grates and at their lower ends by flap gates 48, 54 and 60. Normally, unless sufficient siftings have accumulated immediately before the gates and are being swept forwardly by the paddles of the continuous chains of the removal units, flap gates 48, 54 and 63 will be counter-balanced into closed positions as shown in the drawing to isolate the chambers from each other and prevent intercommunication.

Although the embodiment as described provides for three separate plenum chambers, each provided with a grate unit and a residue removal unit, it is contemplated as being within the scope of the invention to provide other combinations of such features. More specifically, it is contemplated that two or more plenum chambers may be used in combination with one or more grate units and one or more residue removal units. As examples, the stoker may consist of two plenum chambers with one or two grate units and one or two residue removal units, or three plenum chambers with one, two or three grate units and one, two or three residue removal units. In each combination, however, at least two plenum chambers, at least one grate unit and at least one residue removal unit is provided. Preferably, in each of such combinations, a pressure differential is provided across the one or more grate units and temperature differentials are provided in the two or more plenum chambers.

From the foregoing detailed description, it will be evident that there are a number of changes, adaptations and modifications of the present invention which come within the province of those persons having ordinary skill) in the art to which the aforementioned invention pertains. However, it is intended that all such variations not departing from the spirit of the invention be considered as within the scope thereof as limited solely by the appended claims.

I claim:

1. A stoker comprising a housing having side walls and at least one upright partition wall cooperating with said side walls to provide at least first and second plenum chambers, at least one reciprocating type grate unit disposed at and substantially forming a closure of an upper end of said housing and at least one residue removal means disposed at and substantially forming a closure of a lower end of said grate unit whereby said plenum chambers are substantially isolated from each other and the exterior of said housing, said upright partition wall having a flap gate disposed at a lower end thereof and adjacent said residue removal means for allowing passage therethrough of residue advanced by said residue removal means.

2. A stoker according to claim 1 including a separate grate unit forming an upper closure of each of said plenum chambers

3. A stoker according to claim 2 wherein each successive grate unit is disposed at a lower level relative to a preceding grate unit.

4. A stoker assembly according to claim 1 wherein said residue removal means comprises a drag conveyor.

5. A stoker assembly according to claim 1 including means for providing a pressure differential across said grate unit.

6. A stoker according to claim 1 including means for maintaining a pressure differential between said plenum chambers.

7. A stoker according to claim 1 including a separate residue removal means forming a lower closure of each of said plenum chambers.

8. A stoker according to claim 7 wherein each successive residue removal means is disposed at a lower level relative to a preceding residue removal means.

9. A stoker according to claim 1 including two partition walls providing three plenum chambers, and means for maintaining a first plenum chamber at a first positive pressure, a second intermediate plenum chamber at a second positive pressure above said first positive pressure and a third plenum chamber at a third positive pressure below said first positive pressure.

10. A stoker according to claim 9 wherein said first positive pressure consists of two inches of water, said second positive pressure consists of four inches of water and said third positive pressure consists of one inch of water.

* * * * *